US008672696B2

(12) United States Patent
Sakurai

(10) Patent No.: US 8,672,696 B2
(45) Date of Patent: Mar. 18, 2014

(54) HYBRID CONNECTOR AND CABLE WITH SAID CONNECTOR

(75) Inventor: Wataru Sakurai, Kanuma (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 70 days.

(21) Appl. No.: 13/333,180

(22) Filed: Dec. 21, 2011

(65) Prior Publication Data

US 2012/0178303 A1 Jul. 12, 2012

(30) Foreign Application Priority Data

Dec. 27, 2010 (JP) ..... 2010-289418

(51) Int. Cl.
*H01R 13/64* (2006.01)

(52) U.S. Cl.
USPC ..... 439/247; 439/924.1

(58) Field of Classification Search
USPC ..... 439/246–249, 382
See application file for complete search history.

(56) References Cited

U.S. PATENT DOCUMENTS 4,780,090 A * 10/1988 Sugiyama et al. ..... 439/247
4,909,748 A * 3/1990 Kozono et al. ..... 439/247
4,915,641 A * 4/1990 Miskin et al. ..... 439/247
4,942,499 A * 7/1990 Shibata et al. ..... 361/826
5,419,717 A * 5/1995 Abendschein et al. ..... 439/577

FOREIGN PATENT DOCUMENTS

JP 2003-157926 A 5/2003
JP 2006-066352 A 3/2006

* cited by examiner

*Primary Examiner* — Khiem Nguyen
(74) *Attorney, Agent, or Firm* — Global IP Counselors, LLP

(57) ABSTRACT

[Problem] To provide a hybrid connector and a cable with the connector which correct a positional error of connector units and enable to connect connectors when they are connected and even if there is a small positional error of the connection unit.

[Solving Means] A hybrid connector holds plural connector units 2*a* to 4*b* in a common connector housing 5*a*, 5*b*. Each of the plural connector units is held individually movably in a direction (XY) orthogonal to an axial direction (Z) of connection. The connector unit is preferably movably held through a holding member 18 formed by an elastic matter. Front edges at the fitting start of the plural connector units 2*a* to 4*b* are tapered, and the connector units move along tapered portions in the connection fitting time. The plural connector units may be different in front-edge fitting start position along a connecting direction.

4 Claims, 3 Drawing Sheets

HYBRID CONNECTOR AND CABLE WITH SAID CONNECTOR

TECHNICAL FIELD

The present invention relates to a hybrid connector which accommodates different kinds of connectors in a common connector housing is connected to a cable, and a cable to which the hybrid connector is attached.

BACKGROUND ART

In consumer devices such as a personal computer and an audio-video equipment, for connection of transmission signals, various connectors are used such as a D-SUB connector, a PS/2 connector, an MDID connector, a USB connector, a DVI connector, and an HDMI connector. Further, in addition to these connectors, a power supply connector and an optical connector for optical signal are used. Since these connectors are connected to the cables in use, there are such problems as botheration in plural connector connections, and ugliness and trickiness due to congestion of the cables.

For these problems, a hybrid connector has been proposed, in which plural connectors different in type of usage are assembled and integrated in a common connector housing thereby to enable plural connector connections by one attaching/detaching operation. Examples of this hybrid connector include various types of combination of a connector unit for power supply and a connector unit for electric signal (refer to, for example, Patent Document 1); combination of a connector unit for optical signal and a connector unit for electric signal (refer to, for example, Patent Document 2); and the like.

RELATED ART DOCUMENT

Patent Document

[Patent Document 1] JP-A-2006-66352
[Patent Document 2] JP-A-2003-157926

SUMMARY OF THE INVENTION

Problems that the Invention is to Solve

Generally, in the connection between connectors, a receptacle connector and a plug connector are connected and fitted to each other by aligning their center positions with each other. However, in case of the hybrid connector in which the plural connector units are assembled, if relative position or interval between the connector units is slightly shifted by the errors on the manufacture and the like, the center positions of the receptacle-configured connector and the plug-configured connector are not coincident. Therefore, connection/fitting becomes impossible; or connection portion or a contact terminal is deformed in case of forcible connection and connection failure occurs.

The invention has been made in view of the above circumstances, and an object of the invention is to provide a hybrid connector and a cable with the connector which correct a positional error of connector units and enable to connect the connectors when they are connected and even if there is a small positional error of the connection unit.

Means for Solving the Problems

A hybrid connector according to the invention is a hybrid connector which holds a plurality of connector units in a common connector housing. Each of the plurality of connector units is held individually movably in a direction orthogonal to an axial direction of connection. The connector unit is preferably movably held through a holding member formed by an elastic matter. Front edges at the fitting start of the plural connector units 2*a* to 4*b* are tapered, and the connector units move along tapered portions in the connection fitting time. The plural connector units may be different in front-edge fitting start position along a connecting direction.

The plurality of connector units may be different in front-edge fitting start position along a connecting direction. One of the plurality of connector units may be held in a fixed manner.

The hybrid connector may be attached in advance, and a plurality of cables corresponding to the respective connector units may be assembled and integrated, so that a composite cable with a connector is made.

Advantage of the Invention

According to the invention, since each of the plural connector units is held movably in the orthogonal direction to the axial direction of the connection of the connector, even if there is a small error in relative position or interval between the connector units, the connector unit moves and thus the position of the connector unit is corrected in connector connection, so that connection of the connector units can be performed, and poor connection can be also prevented.

MODE FOR CARRYING OUT THE INVENTION

Figure 1:
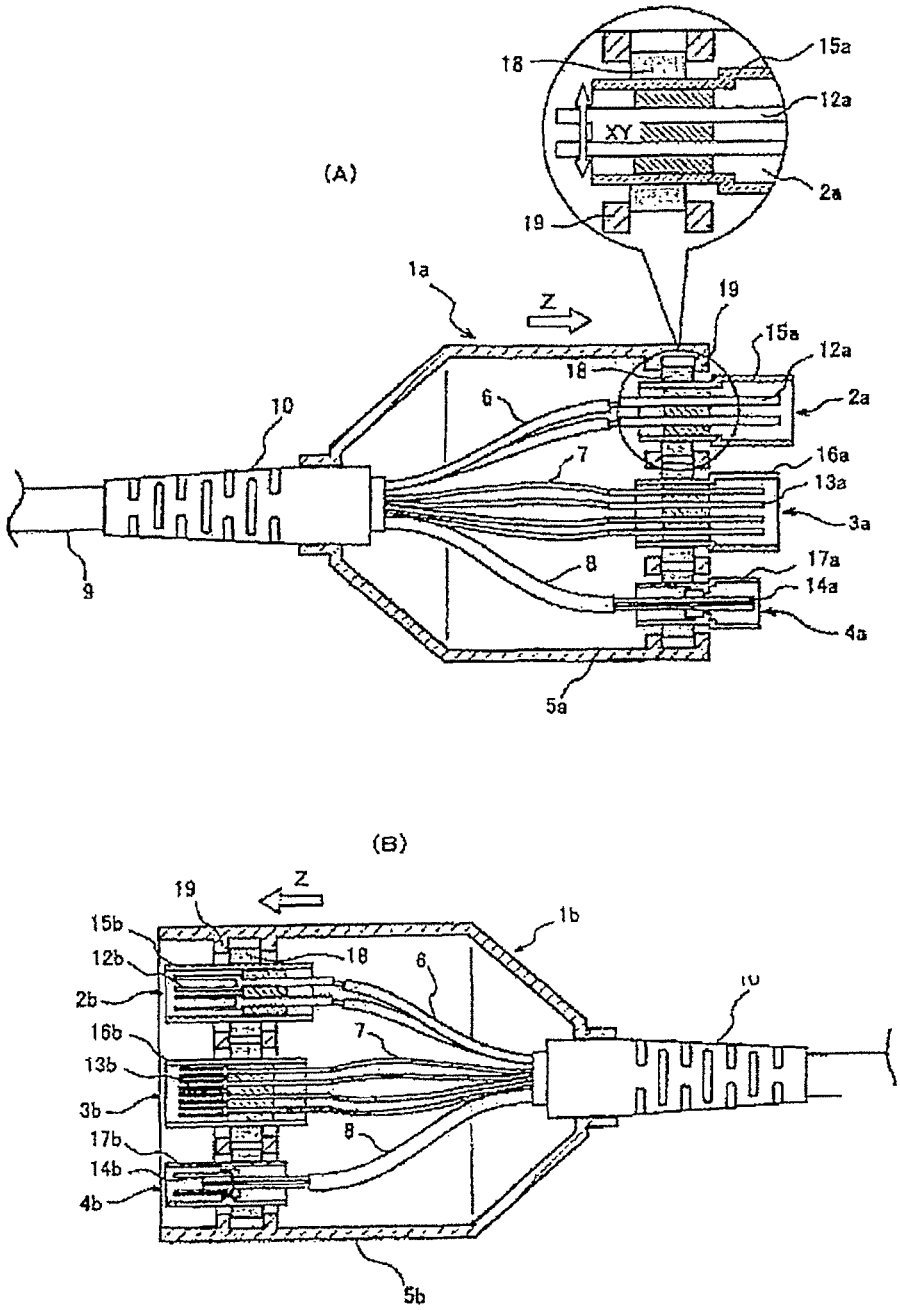
FIG. 1 It is a diagram for explaining an outline of a hybrid connector according to the invention.

With reference to drawings, an outline of the invention will be described. FIG. 1(A) shows a plug-sided hybrid connector, and FIG. 1(B) shows a receptacle-sided hybrid connector. In the figures, reference numerals 1*a* and 1*b* represent hybrid connectors, 2*a* and 2*b* represent connector units for power supply, 3*a* and 3*b* represent connector units for signal, 4*a* and 4*b* represent optical connector units for optical connection, 5*a* and 5*b* represent connector housings, 6 represents a power supply cable, 7 represents a signal cable, 8 represents an optical cable, 9 represents a composite cable, 10 represents a boot, 12*a* and 13*a* represent contact terminals (male-type), 12*b* and 13*b* represent contact terminals (female-type), 14*a* represents an optical connector ferrule, 14*b* represents an optical connector sleeve, 15*a* to 17*b* represent unit housings, 18 represents a holding member, and 19 represents a supporting portion.

In the hybrid connector 1*a*, 1*b*, plural connector units are accommodated and held in one common connector housing 5*a*, 5*b*, and their connector units are connected like one connector. The plural connector units 2*a* to 4*b* may be different in kind or may be the same in kind. The respective electric cables 6, 7 or the optical cable 8 for the plural connector units 2*a* to 4*b* are assembled to become the composite cable 9, and the composite cable 9 is connected through the boot 10 having elasticity to the hybrid connectors 1*a* and 1*b*.

Further, the hybrid connector consists of the plug-sided hybrid connector 1*a* and the receptacle-sided hybrid connector 1*b*, and the plug side and the receptacle side are fitted to each other thereby to make connection. A mode in which the composite cables 9 are connected to each other is exemplified in the figure. By incorporating either hybrid connector into a housing of a communication device, a connection mode of the device and the cable may be adopted. In this case, the receptacle side is frequently arranged in the device, but alternatively the plug side may be arranged in the device.

The plug-sided hybrid connector 1*a*, as shown in a schematic diagram of FIG. 1(A), can be constituted by accommodating and holding three connector units of the connector unit 2*a* for power supply, the connector unit 3*a* for signal and the optical connector unit 4*a* of optical connection into the common connector housing 5*a*. In this case, the connector unit 2*a* for power supply is formed by attaching a pair of male-type contact terminals 12*a* into the unit housing 15*a*, and the connector unit 3*a* for signal is formed by attaching many male-type contact terminals 13*a* into the unit housing 16*a*. Further, the optical connector unit 4*a* for optical connection is formed by attaching the male-type optical connector ferrule 14*a* into the unit housing 17*a*.

The connector units 2*a* to 4*a* are assembled and integrated by holding individually the respective unit housings 15*a* to 17*a* by the supporting portions 19 provided in the common connector housing 5*a*. The connector units 2*a* to 4*a* are arranged movably in an orthogonal direction (XY direction) to an axial direction (for example, a direction of an arrow Z) where the connector unit 2*a* to 4*a* is connected and fitted to the other connector. A movable range is within a range where positional variations among the plural connector units due to errors and differences on the manufacture are covered, and the range refers to a moving distance of 0.5 mm or less.

By holding the connector units 2*a* to 4*a* in the connector housing 5*a* movably, even if there is a small error in relative positions or intervals among the plural connector units, some of the plural connector units are moved in the orthogonal direction to the axial direction, thereby to enable connection and fitting of all of the plural connector units.

However, in a state where all of the plural connector units are fixed to the connector housing, if there is an error in interval between the connector units, the connector unit which is difficult in connection is produced. In case that this connector unit is forcedly connected, the contact terminals and the connector unit deform, so that connection failure occurs.

To hold the connector units 2*a* to 4*a* movably within the above range can be readily realized, for example, by making the holding member 18 attached and fixed to each unit housing 15*a* to 17*a* slidable in relation to the supporting portion 19 of the connector housing 5*a* and providing a clearance around the holding member 18 to support the holding member 18 by the supporting portion 19. In this case, if the holding member 18 is formed of rigid material, the holding member 18 slides while coming into contact with the supporting portion 19 and can move within the clearance range, but the connector unit 2*a* to 4*a*, after being moved, stops at its movement position and can be moved only by the operation from the outside.

By using an elastic matter such as rubber for the holding member 18, it is possible to make the connector units 2*a* to 4*a* elastically movable in relation to the connector housing 5*a* in the XY direction orthogonal to the above axial direction. In this case, in a free state without connector connection, the connector units 2*a* to 4*a* can be held restorably to a predetermined position (home position). In case that there is no positional error between the connector units, the usual connection fitting can be performed without positional correction.

FIG. 1(B) shows the receptacle-sided hybrid connector 1*b*, which can move the connector units similarly to the plug-sided hybrid connector 1*a*. In case that the connector units in the plug-sided hybrid connector 1*a* of a connecting partner are movable, a mode in which all the connector units in the receptacle-sided hybrid connector 1*b* are fixed can be adopted. However, in case that there is a large positional error between the connector units and the error cannot be corrected by only one connector, the connector units in both of the plug-sided hybrid connector 1*a* and the receptacle-sided hybrid connector 1*b* are made movable, whereby the error can be corrected.

The receptacle-sided hybrid connector 1*b* can be constituted similarly to the plug-sided hybrid connector 1*a*. Namely, the receptacle-sided hybrid connector 1*b* is constituted by accommodating and holding, in the common connector housing 5*b*, three connector units of the connector unit 2*b* for power supply, the connector unit 3*b* for signal, and the optical connector unit 4*b* for optical connection. However, a fitting portion of the unit housing of each connector unit in the plug-sided hybrid connector 1*a* is protruded from a front surface of the connector housing, while a fitting portion of the unit housing of each connector unit in the receptacle-sided hybrid connector 1*b* can be arranged inside the connector housing.

The connector unit 2*b* for power supply in the receptacle-sided hybrid connector 1*b* is formed by attaching a pair of female-type contact terminals 12*b* into the unit housing 15*b*, and the connector unit 3*b* for signal is formed by attaching many female-type contact terminals 13*b* into the unit housing 16*b*. The optical connector unit 4*b* is formed by attaching the female-type optical connector sleeve 14*b* into the unit housing 17*b*. Further, similarly to in the plug-sided hybrid connector 1*a*, by supporting the holding member 18 attached and fixed to the unit housing 15*b* to 17*b* by the supporting portion 19 of the connector housing 5*b* with a clearance provided around the holding member 18, and using an elastic member such as rubber for the holding member 18, the connector units 2*b* to 4*b* can be elastically held in relation to the connector housing 5*b*.

Figure 2:
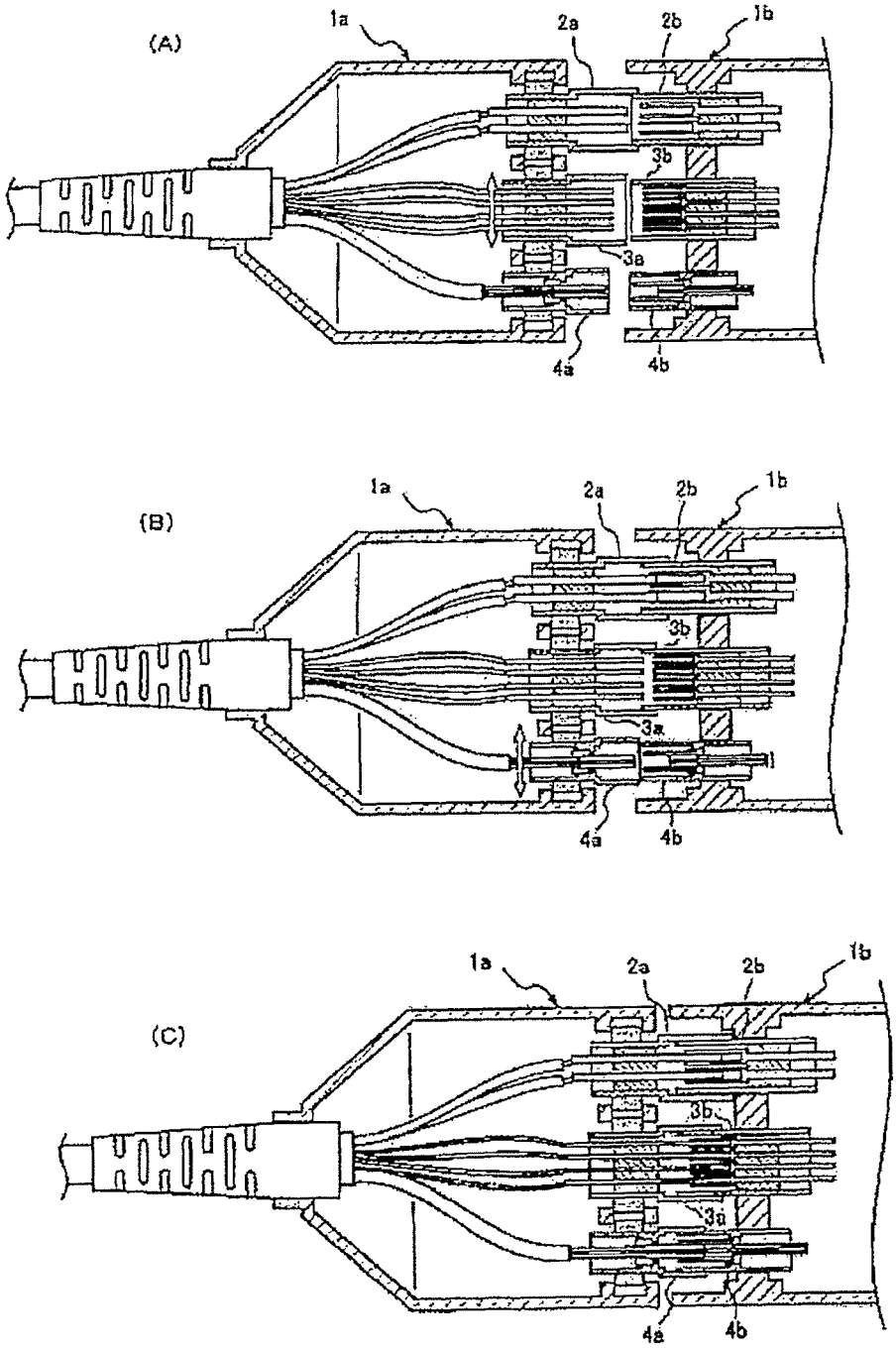
FIG. 2 It is a diagram for explaining a connection mode of the hybrid connector according to the invention.

FIG. 2 is a diagram for explaining a method of connection by means of the hybrid connector in FIG. 1 with correction of the positional error. In the explanation, the receptacle-sided hybrid connector 1*b* has a mode in which the connector units 2*b* to 4*b* are not moved but fixed. Further, in the hybrid connector, in order to lower the insertion force in the connection starting time, connection timing of the plural connector units are frequently made different. Also in this example, the plug-sided hybrid connector 1*a* is preferably formed so that timing of connection fitting is different among the connector units by making the protruding lengths of the plural connector units different.

As shown in the figure, in the plug-sided hybrid connector 1*a*, for example, the protruding amount of the connector unit 2*a* for power supply is largest, and the connector unit 2*a* is firstly connected and fitted. The protruding amount of the connector unit 3*a* for signal is next largest, and the protruding amount of the optical connector unit 4*a* for optical connection is smallest. The magnitude of the protruding amount is not limited to this example, but can be set arbitrarily. Further, in the receptacle-sided hybrid connector 1*b*, front-edge positions of the connector units are almost the same in this example, but may be made different similarly to in the plug-sided hybrid connector.

Regarding connection between the hybrid connectors 1*a* and 1*b*, as shown in FIG. 2(A), firstly, connection/fitting between the connector unit 2*a* having the largest protruding amount and the connector unit 2*b* is started. Regarding the connector units connected and fitted firstly, since a connection operator performs adjustment so that the connector unit 2*a* is aligned with the connector unit 2*b*, the connector unit 2*a* does not need to be movable. Next, connection/fitting between the connector units 3*a* and 3*b* is started. In case that there is a positional error between the connector units 3*a* and 3*b*, the connector unit 3*a* moves in relation to the connector unit 2*a* which has been already connected and fitted so that the fitting position of the connector unit 3*a* becomes the same as the fitting position of the connector unit 3*b*, thereby to be fitted to the connector unit 3*b*.

Figure 3:
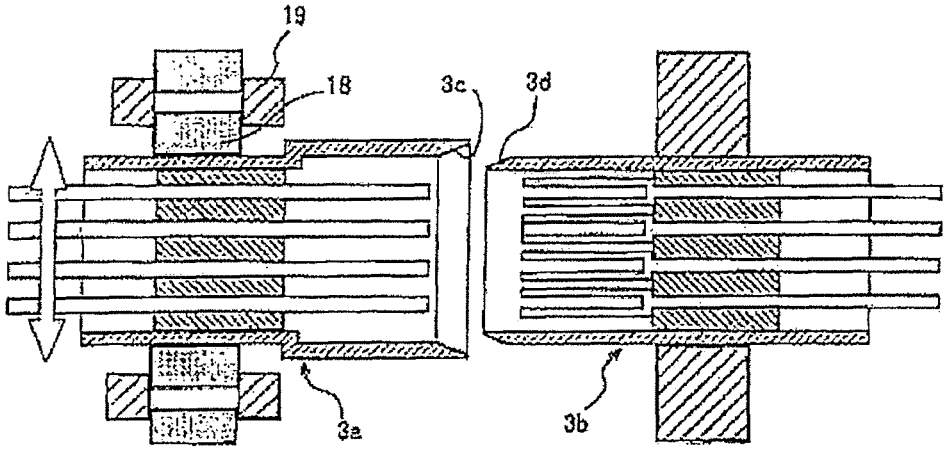
FIG. 3 It is a diagram showing an example in which a front edge of a connector unit used in the invention is tapered.

In this time, as shown in FIG. 3, at front edges of the connector units 3*a* and 3*b* which become fitting start positions, tapered-configurations 3*c* and 3*d* are fowled, and the connector unit 3*a* is smoothly moved along the tapered surface. After the connector units 3*a* and 3*b* have been aligned with each other, as shown in FIG. 2(B), the connector units 3*a* and 3*b* are connected and fitted. Regarding the connector units 2*a* and 2*b* which have been already connected and fitted, the fitted amount between them is increased.

Thereafter, connection/fitting between the connector units 4*a* and 4*b* is started. In case that there is a positional error between the connector units 4*a* and 4*b*, the connector unit 4*a* moves in relation to the connector units 2*a* and 3*a* which have been already connected and fitted so that the fitting position of the connector unit 4*a* becomes the same as the fitting position of the connector unit 4*b*, thereby to be fitted to the connector unit 4*b*. In this time, similarly to in the connector units 3*a* and 3*b*, at front edges of the connector units 4*a* and 4*b*, tapered-configurations (not shown) are formed, along which the connector unit 4*a* is smoothly moved. After the connector units 4*a* and 4*b* have been aligned with each other, as shown in FIG. 2(C), the connector units 4*a* and 4*b* are connected and fitted similarly to the above. Regarding the connector units 2*a*, 2*b* and 3*a*, 3*b* which have been already connected and fitted, the fitted amount is further increased.

In the connection between the connector units to be firstly connected and fitted, that is, in the example of FIG. 2, in the connection between the connector units 2*a* and 2*b*, since the connection operator adjusts the fitting positions of the connector units 2*a* and 2*b*, the connector unit 2*a* may be a fixed type. Since making the connector unit movable increases the cost, if any one of the connector units is the fixed type, the cost is reduced.

DESCRIPTION OF REFERENCE NUMERALS AND SIGNS

1*a*, 1*b* Hybrid connector, 2*a*, 2*b* Connector unit for power supply, 3*a*, 3*b* Connector unit for signal, 4*a*, 4*b* Optical connector unit for optical connection, 5*a*, 5*b* Connector housing, 6 Power supply cable, 7 Signal cable, 8 Optical cable, 9 Composite cable, 10 Boot, 12*a*, 13*a* Contact terminal (male-type), 12*b*, 13*b* Contact terminal (female-type), 14*a* Optical connector ferrule, 14*b* Optical connector sleeve, 15*a* to 17*b* Unit housing, 18 Holding member, 19 Supporting portion

The invention claimed is:

1. A hybrid connector which holds a plurality of connector units in a common connector housing, the plurality of connector units being different in front-edge fitting start position along a connecting direction, such that one of the plurality of connector units having a largest protruding amount being held in a fixed manner, and each of the other ones of the plurality of connector units being held in the common connector housing individually movably in a direction orthogonal to an axial direction of connection.

2. The hybrid connector according to claim 1, wherein the connector unit is movably held through a holding member formed by an elastic matter.

3. The hybrid connector according to claim 1, wherein a front edge of one of the connector units is tapered and moves along a tapered portion in a connection fitting time.

4. A composite cable to which the hybrid connector according to claim 1 is attached, wherein a plurality of cables corresponding to the respective connector units are assembled and integrated.

* * * * *